United States Patent [19]

Owens

[11] Patent Number: 4,930,183

[45] Date of Patent: Jun. 5, 1990

[54] CANOPY-SUPPORT HINGE DEVICE

[76] Inventor: T. Douglas Owens, 108 Shepherd Trail, Longwood, Fla. 32750

[21] Appl. No.: 248,933

[22] Filed: Sep. 26, 1988

[51] Int. Cl.[5] ..... E05D 7/00

[52] U.S. Cl. ..... 16/260; 403/353

[58] Field of Search ..... 16/261, 262, 260; 403/353, 122, 323, 91

[56] References Cited

U.S. PATENT DOCUMENTS

| | | | |
|---|---|---|---|
| 770,595 | 9/1904 | Lovette | 16/260 |
| 860,632 | 7/1907 | Breithut | 16/260 |
| 1,496,466 | 6/1924 | Jackson | 16/260 |

*Primary Examiner*—Richard K. Seidel

*Assistant Examiner*—Carmine Cuda

*Attorney, Agent, or Firm*—Edward M. Livingston

[57] ABSTRACT

A canopy-support hinge comprising a base member and bolt member is provided. The hinge base member is provided with an open side having a hinge bolt aperture. The open side of said base member is narrower than the diameter of the bolt aperture. The hinge bolt member is provided with two flat parallel sides to make the bolt narrow enough to be passed through the open side but to be contained when the bolt is rotated to different positions. A flanged bolt head and connector means on the bolt member for attaching canopy support tube members thereto renders this device advantageous for forming canopies on boats and on other structures.

16 Claims, 2 Drawing Sheets

FIG 1
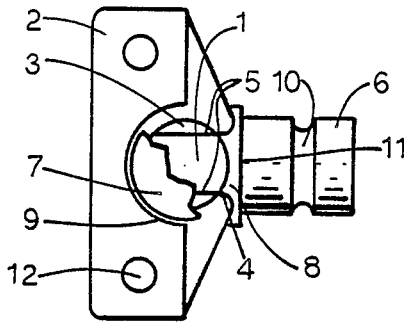
FIG 2
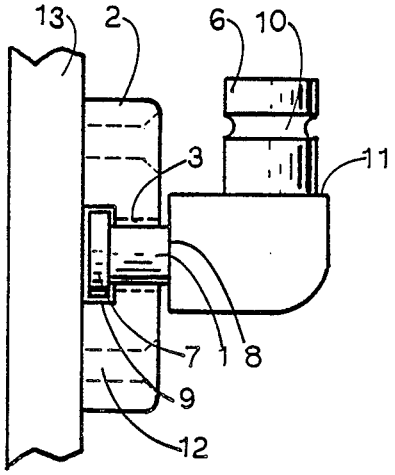
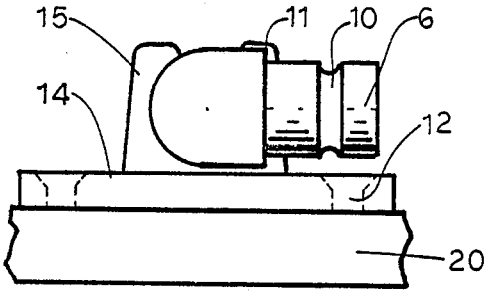
FIG 3
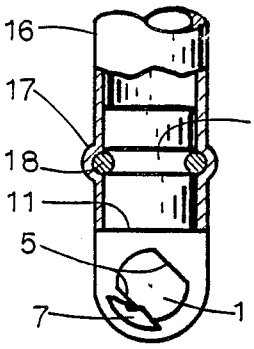
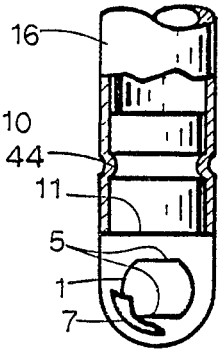
FIG 4
FIG 5
FIG 6
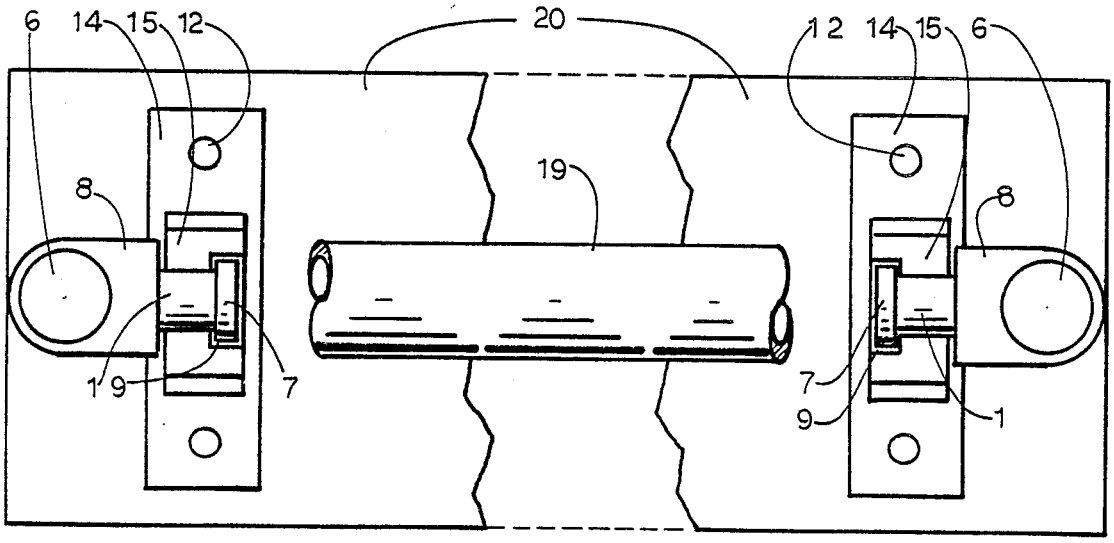

CANOPY-SUPPORT HINGE DEVICE

BACKGROUND OF THE INVENTION

This invention relates to a quick and convenient device and method for setting up and taking down canvas and other fabric canopy covers on boats, trucks, buildings, other structures and even ground surfaces. It is a form of temporary building, storage cover or tent when used in relation to ground surfaces and some other structures.

Fabric covers are one of the oldest arts of civilization for temporary coverings and dwellings. In current practice, canopies with tube supports for canvas and other fabric coverings have become quite common. Particularly for boats, they have become popular for quick set-up and removal in response to weather conditions affecting comfort and safety related to marine activities.

Most of the canopy support practices employed currently utilize a simple bolting of ends of canopy tubes and rods through their diameters to support members at either or both sides of the tubes. One of the most popular on the market uses an eye in a flat attachment to a canopy tube for bolting to a threaded member attached to a boat frame. These most popular current devices involve tedious turning in and out of bolts. There is always the likelihood of the bolts being lost, particularly in rough marine conditions when the covers are most likely to be required. Bolt ends are often sharp and injurious in present methods. Various wrenches and screwdrivers are required and may be time-consuming to find or may be lost or dropped overboard in the use-conditions for which they are intended. Nearly all use-conditions for canopies are fraught with these same problems in various manners and to various degrees. Most use-conditions are benefited by this invention in similar ways.

Some of the most commonly-used methods are so simple that they are not patented. No patented or unpatented methods have been found with the advantages and working relationship of parts utilized in this invention.

SUMMARY OF THE INVENTION

The primary object of the instant invention is to provide a hinge device for supporting canopies.

A related object of this invention is to provide such a device that makes attaching and detaching canopies quicker and easier than with prior devices.

Another related object of this invention is to provide such a device that decreases breakage of canopy support members, thereby reducing costs to the consumer.

Another object of this invention is to provide such a device wherein all parts fit together without loose parts, such as separate bolts, which could be lost, which is the case with canopy support members in the prior art.

Even another object of this invention is to provide such a device which does not require wrenches, screwdrivers or other tools to assemble.

A further object of the instant invention is to provide methods of using the canopy-support hinge device.

This invention accomplishes the above and other objects by providing a device consisting of a canopy-support hinge base member and a canopy-tube hinge bolt member, said base member having a cylindrical hinge-bolt aperture with a select linear orifice in the outer portion of the hinge-bolt aperture open to receive the hinge bolt when said hinge bolt is turned side-to-side as the oppositely-disposed sides of the bolt are flat and parallel linearly to the axis of the bolt. The open edge of the hinge-bolt aperture in the hinge base is wide enough to receive the hinge bolt at the parallel sides but not wide enough to allow the hinge bolt to pass through the said aperture when the hinge bolt is rotated to a position in which its parallel flat sides are not tangentially in-line with the open edge of the said aperture.

The hinge base is provided with a hinge-bolt-head channel wide enough to receive the bolt head from side-to-side. The canopy-tube attachment means is too wide to enter the hinge-bolt-head channel, however, such that the hinge bolt can be inserted into the cylindrical hinge-bolt aperture in the hinge base only with the canopy-tube attachment means at the opposite surface of the hinge base from the hinge-bolt-head channel.

An insertable-rod canopy-support attachment means is projected at a select angle from the opposite end of the attachment means from the flanged hinge bolt head. Canopy support members are inserted into the attachment means and the canopy material is attached by snapping or tying at sides of the hinges to form canopy coverings.

This forms a convenient type of canopy. It is also a form of tent. A wide variety of portable, temporary and relatively permanent types of canopies, coverings and tents utilizing this invention are foreseeable.

Canopies for windows on buildings also are described by vertical mountings of this invention. For vertical window canopies, it is desirable to construct the flats on the hinge bolt selectively non-parallel to the axis of the insertable rod such that the hinge bolts can be inserted or removed only when the angle of the canopy support members exceeds the range of the operating angle.

Use methods are described for utilizing this hinge system for reliable, convenient and quick set-up and quick removal of fabric coverings, dwellings and shelters.

The objects, advantages and features of the invention will become readily apparent from the following detailed description of the specific embodiments thereof when read in conjunction with the accompanying drawings.

BRIEF DESCRIPTION OF THE DRAWINGS

This invention can be understood more clearly by reference to the enclosed drawings wherein:

FIG. 1 is an end view of a side-mount hinge base in assembly with a hinge bolt from an end of a hinge bolt.

FIG. 2 is a side view of a side-mount hinge base in assembly with a hinge bolt from a side of a hinge bolt.

FIG. 3 is a side view of a horizontal or deck-mount hinge base in assembly with a hinge bolt from a side of an insertable-rod attachment member.

FIG. 4 is a side view of an insertable-rod attachment member in assembly with a tubular section of a canopy support member and an end of a hinge bolt with a 45-degree slant between the rod and flats on the hinge bolt.

FIG. 5 is a side view of an insertable-rod attachment member in assembly with a tubular section of a canopy support member and an end of a hinge bolt with a 90-degree slant between the rod and flats on the hinge bolt.

FIG. 6 is a top view of a pair of deck-mounted or horizontal-mounted hinge bases in assembly with a section of canopy tube extended between them.

DESCRIPTION OF THE PREFERRED EMBODIMENTS

Figure 7:
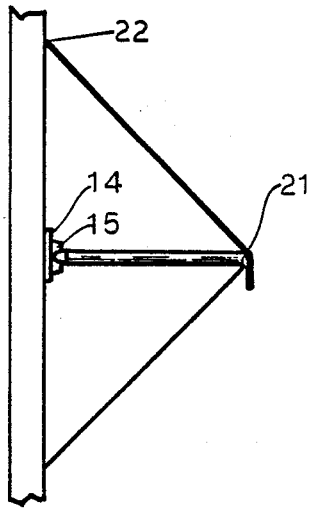
FIG. 7 is a side view of a vertically-mounted canopy hinge in use relationship to a window canopy.

Referring to FIG. 1, a canopy-hinge bolt 1 is held in swivelable relationship to a side-mount canopy hinge base 2 by hinge-bolt aperture 3 with aperture open side 4 through which parallel bolt flats 5 are inserted when insertable-rod 6 is rotated to a position to cause the parallel bolt flats to be in line with the aperture open side. Except when the bolt flats are in line with the open side of the aperture, the hinge bolt is prevented from being dislodged from the bolt aperture by flanged bolt head 7 at one end and by rod base 8 at the other end. The hinge bolt can be inserted only in the designed direction as a result of bolt-head channel 9 that is sufficiently wide to allow entry of the bolt head but too narrow for entry of the rod base.

The rod is insertable into the inside diameter of tubular portions of canopy support members as a canopy-attachment means. A circumferential indentation 10 is provided for attaching a canopy tube attachment 16 with indentation 21 as shown in FIG. 5 or for optional gluing material or for a resilient member to assist firmness of holding power between the rod and tubular members into which it is inserted. Tubular members attached to the rod are prevented from traveling over the rod by stopper ridge 11.

The hinge base illustrated in FIG. 1 is attached to sides of vertical walls by threaded fasteners extended through fastener orifices 12 inserted from opposite side of the base.

Referring to FIG. 2, the same components are illustrated attached to a vertical wall 13 from a different view. In this view, the hinge bolt is rotated to a position in which the parallel bolt flats are at right angles to the open side of the aperture and the diameter of the bolt is represented by broken lines.

Referring to FIG. 3, a deck-mount hinge base 14 utilizes the same hinge bolt in the same working relationship. The deck-mount hinge is the same except for its construction with an aperture housing 15 with the axis of the bolt aperture at right angles to the axis of the fastener orifices. The deck-mount hinge base is used on either horizontal or vertical surfaces for support of canopy weight. Typical uses of the deck-mount hinge base are for supporting canopy frames for decks of marine craft, ground-surface tents and vertical-surface window awnings. By contrast, a typical use of the side-mount hinge base is for supporting canopy weight vertically from a side wall of a marine vehicle or other structure.

Referring to FIG. 4, a hinge bolt is shown separately from a hinge base. A canopy tube attachment section 16 is shown with a matching tubular indentation 17 for a resilient member 18 to assist snugness of contact for holding the tube to the insertable bolt. The bolt flats are shown at an angle not parallel to the axis of the insertable rod. In this case, the angle is 45 degrees from the axis of the insertable rod.

In lieu of the resilient member, gluing substance could be utilized for a relatively permanent attachment of the tube to the rod. The indentation in the rod would convey glue around the circumference of the two members being attached.

The purpose of this angle is to provide the capability of inserting the bolt at an angle different from normal operating angles of canopy support members. An example would be a window awning. The bolt could be insertable at 45 degrees down from horizontal. Then the material of the awning would be fastened above the hinges to prevent the awning from falling below right angles to a building on which it were mounted. The awning canopy could be raised and lowered within its range of operation without causing the flats to be in line with the open side of the aperture unless the awning were detached at the top.

Referring to FIG. 5, the same components are shown but without the resilient member 10 and instead a matching tubular indentation 44 on the canopy attachment tube 16 to hold the tube 16 on the device. Also, the bolt flats are at right angles to the axis of the insertable rod 16.

Referring to FIG. 6, a pair of deck-mount hinges is shown in oppositely-disposed relationship with a canopy tube section 19 extended between them. It can be noted that the rod is positioned at the outside on both sides of deck 20 or other structure. This allows canvas or other material used for a canopy to hang over the side of the deck for maximized coverage and protection from weather conditions.

Referring to FIG. 7, a use method for a window awning canopy 21 is shown in relationship to deck-mount hinges. An awning top 22 is fastened above the hinge and optionally below it also.

Figure 8:
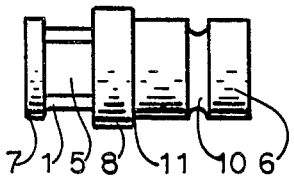
FIG. 8 is a side view of a hinge bolt with a straight insertable rod.

Referring to FIG. 8, a hinge bolt with a straight connector rod is illustrated for straight bar attachments and for tubular attachments with separate angles for special design applications.

Figure 9:
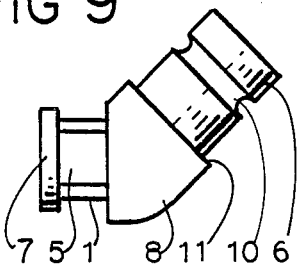
FIG. 9 is a side view of a hinge bolt with an insertable rod at a 45-degree angle from the axis of the hinge bolt.

Referring to FIG. 9, a connector rod is shown at an angle between a right angle and a straight angle. It demonstrates applications for A-shaped canopy applications.

Figure 10:
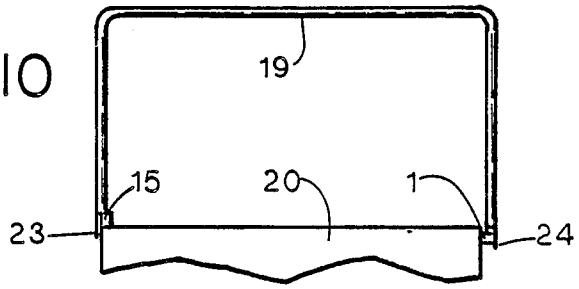
FIG. 10 is an end view of a pair of canopy hinges in use relationship to a right-angled canopy tube covering a boat deck or other structure and illustrating a deck-mounted hinge at the left side and a side-mounted hinge at the right side.

Referring to FIG. 10, a front view of a rectangular canopy illustrates a deck with a deck-mount hinge on the left and a side-mount hinge on the right. The deck could also be any surface such as the ground for a tent or other covering. With either deck-mount or side-mount embodiments of this invention, the canopy material can hang over the sides as illustrated by left overhang 23 and right overhang 24 materials. Typically, the same embodiment would be used for both sides, although the two different types may be used a different locations throughout a boat covering or other application.

Figure 11:
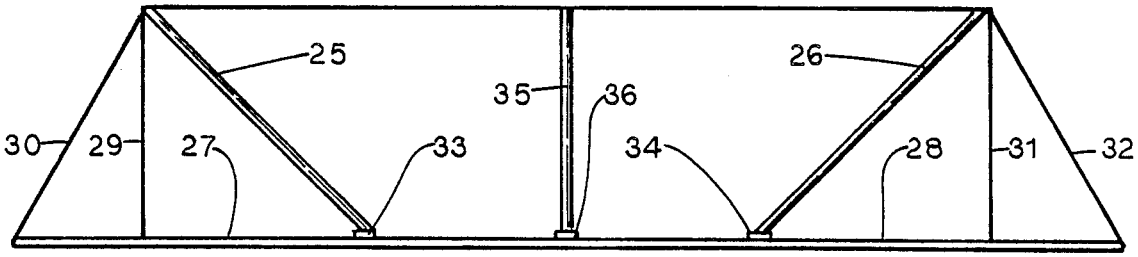
FIG. 11 is a side view of a tent-type covering with an obtuse angle between end canopy supports and acute angles between end canopy supports and a base.

Referring to FIG. 11, a method of using the hinges for a canopy is illustrated with an obtuse angle between left end canopy member 25 and right end canopy member 26. The obtuse angle between the two ends leaves an acute angle between a left base 27 and the left end canopy member and between a right base 29 and the right end canopy member respectively. These acute angles enable either a vertical left end anchor 29 or an angled left end anchor 30 and either a vertical right end anchor 31 or an angled right end anchor 32 to be employed as the only tie down means necessary besides the anchoring of the left hinge 33 and the right hinge 34. Central canopy support member 35 with central hinge 36 and additional such members and hinges are optional for the length of tent or covering for which this invention is utilized. This enclosure could be set up over a marine location also for covering boats. Either a rounded or an A-frame canopy may be desirable for some storage or dwelling applications.

Figure 12:
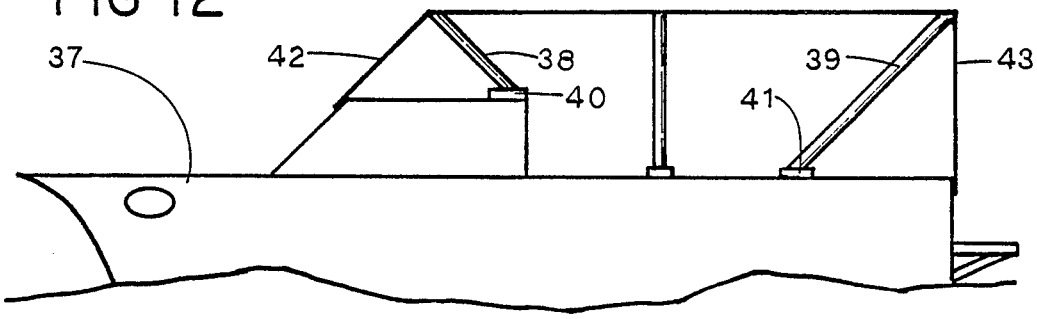
FIG. 12 is a side view of canopy tube hinges supporting a cover over the forward and aft sections of a boat.

Referring to FIG. 12, a boat 37 is shown in relationship to a relatively short cabin canopy support member 38 and a longer aft canopy support member 39. They are attached at their base to forward hinge 40 and aft hinge 41. They are anchored with forward and aft extension members 42 and 43 respectively. The extension members can be fabric portions of the canopy covering, a windshield in the case of the forward boat position, or either solid or flexible cords.

While specific embodiments of the invention have been described in detail hereinabove, it is to be understood that various modifications may be made from the specific details described hereinabove without departing from the spirit and scope of the invention as set forth in the appended claims.

Having described in detail my invention, I claim the following:

1. A canopy-support hinge comprising:

a canopy-support hinge base;

a canopy-support hinge bolt having two oppositely-disposed sides uniformly flat with a selective distance between them and parallel to the axis of the bolt;

a cylindrical hinge-bolt aperture in the hinge base;

a linear open edge of the hinge-bolt aperture with an orifice wide enough to allow entry of the hinge bolt linearly at the parallel sides but not wide enough to allow the hinge bolt to pass through the said orifice when the hinge bolt is rotated to a position in which the parallel flat sides of the hinge bolt are not tangentially in line with the linear open edge;

a flanged bolt head selectively larger than the diameter of the hinge bolt at one end of the hinge bolt; and a means for attachment of the bolt to a tubular end of a canopy-support member at the opposite end and perpendicular to the axis of the hinge bolt from the flanged head said attachment means includes a rod whereby the rod matingly fits inside the tubular end.

2. A canopy-support hinge as described in claim 1 wherein:

the means for attachment is comprised of a cylindrical rod attached to the hinge bolt and insertable snugly inside of a canopy tube.

3. A canopy-support hinge as described in claim 2 and further comprising:

a circumferential indentation sized and shaped in the cylindrical rod to receive optionally a circular resilient member for engaging snugly the inside diameter of a matching circumferential indentation in the inside diameter of a canopy tube or to receive gluing material for attaching the rod to the inside diameter of a canopy tube or to receive an indentation in the outer diameter of a canopy tube to enable said tube to rotate.

4. A canopy-support hinge as described in claim 3 and further comprising:

a stopper ridge at the base of the cylindrical rod member.

5. A canopy-support hinge as described in claim 4 wherein:

the cylindrical rod is projected at a select angle from the axis of the hinge bolt; and parallel flat sides of the hinge bolt are parallel to the plane of the axis of the cylindrical rod.

6. A canopy-support hinge as described in claim 1 wherein:

the means for attachment of the bolt to tubular ends of canopy-support members at the opposite end of the hinge bolt is comprised of a cylindrical rod insertable snugly inside of a tubular end of a canopy-support member;

the cylindrical rod is projected at a select angle from the axis of the hinge bolt; and each of the parallel flat sides of the hinge bolt are in a plane selectively offset from the axis of the hinge bolt.

7. A canopy-support hinge as described in claim 6 and further comprising:

a circumferential indentation sized and shaped in the cylindrical rod to receive optionally a circular resilient member for engaging snugly the inside diameter of a matching circumferential indentation in the inside diameter of a canopy tube or to receive gluing material for attaching the rod to the inside diameter of a canopy tube; and a stopper ridge at the base of the cylindrical rod member.

8. A canopy-support hinge as described in claim 1 and further comprising:

a hinge-bolt-head channel in the hinge base wide enough to receive the bolt head when the hinge bolt is inserted into the hinge-bolt aperture; and a cylindrical-rod base that is too wide to enter the hinge-bolt-head channel, such that the hinge bolt can be inserted into the cylindrical hinge-bolt aperture in the hinge base only with the cylindrical rod at an opposite surface of the hinge base from the hinge-bolt-head channel.

9. A canopy-support hinge as described in claim 1 and further comprising:

a cylindrical rod attached to the hinge bolt at a select angle from the axis of the hinge bolt and insertable snugly inside of a canopy tube;

a circumferential indentation sized and shaped in the cylindrical rod to receive optionally a circular resilient member for engaging snugly the inside diameter of a matching circumferential indentation in the inside diameter of a canopy tube or to receive gluing material for attaching the rod to the inside diameter of a canopy tube or to receive an indentation in the outer diameter of a canopy tube to enable said tube to rotate;

a stopper ridge at the base of the cylindrical rod member;

parallel flat sides of the hinge bolt parallel to the plane of the axis of the cylindrical rod;

a hinge-bolt-head channel in the hinge base wide enough to receive the bolt head from side-to-side when the hinge bolt is inserted from side-to-side into the hinge-bolt aperture; and a cylindrical-rod base that is too wide to enter the hinge-bolt-head channel, such that the hinge bolt can be inserted into the cylindrical hinge-bolt aperture in the hinge base only with the cylindrical rod at an opposite surface of the hinge base from the hinge-bolt-head channel.

10. A canopy-support hinge as described in claim 1 and further comprising:

a cylindrical rod attached to the hinge bolt at a select angle from the axis of the hinge bolt and insertable snugly inside of a canopy tube;

a circumferential indentation sized and shaped in the cylindrical rod to receive optionally a circular resilient member for engaging snugly the inside diameter of a matching circumferential indentation in the inside diameter of a canopy tube or to receive gluing material for attaching the rod to the inside diameter of a canopy tube or to receive an indentation in the outer diameter of a canopy tube to enable said tube to rotate;

a stopper ridge at the base of the cylindrical rod member;

parallel flat sides of the hinge bolt offset from the plane of the axis of the cylindrical rod;

a hinge-bolt-head channel in the hinge base wide enough to receive the bolt head when the hinge bolt is inserted into the hinge-bolt aperture; and a cylindrical-rod base that is too wide to enter the hinge-bolt-head channel, such that the hinge bolt can be inserted into the cylindrical hinge-bolt aperture in the hinge base only with the cylindrical rod at an opposite surface of the hinge base from the hinge-bolt-head channel.

11. A canopy-support hinge as described in claim 10 and further comprising:

hinge-base attachment bolt holes selective positioned at each side of and perpendicular to the hinge-bolt aperture.

12. A canopy-support hinge as described in claim 1 and further comprising:

hinge-base attachment bolt holes selectively positioned at each side of and perpendicular to the hinge-bolt aperture.

13. A canopy-support hinge as described in claim 1 and further comprising:

hinge-base attachment bolt holes selectively positioned at each side of and parallel to the hinge-bolt aperture.

14. A canopy-support hinge as described in claim 13 and further comprising:

a cylindrical rod attached to the hinge bolt at a select angle from the axis of the hinge bolt and insertable snugly inside of a canopy tube;

a circumferential indentation sized and shaped in the cylindrical rod to receive optionally a circular resilient member for engaging snugly the inside diameter of a matching circumferential indentation in the inside diameter of a canopy tube or to receive gluing material for attaching the rod to the inside diameter of a canopy tube or to receive an indentation in the outer diameter of a canopy tube to enable said tube to rotate;

a stopper ridge at the base of the cylindrical rod member;

parallel flat sides of the hinge bolt offset from the plane of the axis of the cylindrical rod;

a hinge-bolt-head channel in the hinge base wide enough to receive the bolt head from side-to-side when the hinge bolt is inserted from side-to-side into the hinge-bolt aperture; and a cylindrical-rod base that is too wide to enter the hinge-bolt-head channel, such that the hinge bolt can be inserted into the cylindrical hinge-bolt aperture in the hinge base only with the cylindrical rod at an opposite surface of the hinge base from the hinge-bolt-head channel.

15. A canopy-support hinge as described in claim 1 and further comprising:

hinge-base attachment bolt holes selectively positioned at each side of and parallel to the hinge-bolt aperture;

a cylindrical rod attached to the hinge bolt at a select angle from the axis of the hinge bolt and insertable snugly inside of a canopy tube;

a circumferential indentation sized and shaped in the cylindrical rod to receive optionally a circular resilient member for engaging snugly the inside diameter of a matching circumferential indentation in the inside diameter of a canopy tube or to receive gluing material for attaching the rod to the inside diameter of a canopy tube or to receive an indentation in the outer diameter of a canopy tube to enable said tube to rotate;

a stopper ridge at the base of the cylindrical rod member;

parallel flat sides of the hinge bolt parallel to the plane of the axis of the cylindrical rod;

a hinge-bolt-head channel in the hinge base wide enough to receive the bolt head from side-to-side when the hinge bolt is inserted from side-to-side into the hinge-bolt aperture; and a cylindrical-rod base that is too wide to enter the hinge-bolt-head channel, such that the hinge bolt can be inserted into the cylindrical hinge-bolt aperture in the hinge base only with the cylindrical rod at an opposite surface of the hinge base from the hinge-bolt-head channel.

16. A canopy-support hinge as described in claim 1 and further comprising:

hinge-base attachment bolt holes selectively positioned at each side of and perpendicular to the hinge-bolt aperture;

a cylindrical rod attached to the hinge bolt at a select angle from the axis of the hinge bolt and insertable snugly inside of a canopy tube;

a circumferential indentation sized and shaped in the cylindrical rod to receive optionally a circular resilient member for engaging snugly the inside diameter of a matching circumferential indentation in the inside diameter of a canopy tube or to receive gluing material for attaching the rod to the inside diameter of a canopy tube or to receive an indentation in the outer diameter of a canopy tube to enable said tube to rotate;

a stopper ridge at the base of the cylindrical rod member;

parallel flat sides of the hinge bolt parallel to the plane of the axis of the cylindrical rod;

a hinge-bolt-head channel in the hinge base wide enough to receive the bolt head from side-to-side when the hinge bolt is inserted from side-to-side into the hinge-bolt aperture; and a cylindrical-rod base that is too wide to enter the hinge-bolt-head channel, such that the hinge bolt can be inserted into the cylindrical hinge-bolt aperture in the hinge base only with the cylindrical rod at an opposite surface of the hinge base from the hinge-bolt-head channel.

* * * * *